United States Patent [19]

Rowland

[11] Patent Number: 4,700,900

[45] Date of Patent: Oct. 20, 1987

[54] TWO STAGE REFINER

[75] Inventor: Stephen A. Rowland, Montreal, Canada

[73] Assignee: Hymac Ltd., Quebec, Canada

[21] Appl. No.: 808,686

[22] Filed: Dec. 17, 1985

Related U.S. Application Data

[63] Continuation of Ser. No. 588,980, Mar. 13, 1984, abandoned.

[30] Foreign Application Priority Data

Oct. 24, 1983 [CA] Canada ..... 439565

[51] Int. Cl.[4] ..... B02C 7/14

[52] U.S. Cl. ..... 241/37; 162/28; 241/78; 241/79.1; 241/163; 241/247; 241/261.2; 241/297

[58] Field of Search ..... 162/24–28, 162/261; 241/37, 161, 162, 163, 28, 244, 261.2, 296, 261.3, 297, 298, 78, 79.1, 245

[56] References Cited

U.S. PATENT DOCUMENTS

| | | | |
|---|---|---|---|
| 608,085 | 7/1898 | Straub | 241/163 |
| 2,864,562 | 12/1958 | Eberhardt et al. | 241/163 |
| 3,323,731 | 6/1967 | Asplund et al. | 241/163 X |
| 3,654,075 | 4/1972 | Keyes et al. | 241/37 X |
| 4,235,665 | 11/1980 | Reinhall et al. | 241/28 X |
| 4,247,362 | 1/1981 | Williams | 162/28 |
| 4,298,425 | 11/1981 | Ranzen et al. | 162/261 |
| 4,357,208 | 11/1982 | Peterson et al. | 162/28 |
| 4,455,195 | 1/1984 | Kinsley | 162/28 |
| 4,457,804 | 7/1984 | Reinhall | 162/261 |

FOREIGN PATENT DOCUMENTS

| | | | |
|---|---|---|---|
| 317355 | 11/1931 | Canada . | |
| 394296 | 9/1941 | Canada . | |
| 783928 | 4/1968 | Canada | 162/261 |
| 1125077 | 8/1982 | Canada . | |
| 45359 | 1/1972 | Finland . | |
| 1093443 | 4/1953 | France . | |
| 187040 | 12/1963 | Sweden . | |
| 413601 | 9/1980 | Sweden . | |
| 433365 | 5/1984 | Sweden . | |
| 562426 | 9/1977 | U.S.S.R. | 241/245 |
| 644894 | 1/1979 | U.S.S.R. . | |

*Primary Examiner*—Mark Rosenbaum

*Attorney, Agent, or Firm*—James W. Hellwege

[57] ABSTRACT

A paper pulp refiner for refining high consistency stock characterized by two virtually identical refining zones connected in series which have an interstage device to remove excess steam and whose axial loads can be varied independently thus producing two stage pump from a single refiner.

8 Claims, 2 Drawing Figures

TWO STAGE REFINER

This application is a continuation of application Ser. No. 588,980, filed Mar. 13, 1984, now abandoned.

The present invention relates generally to high consistency pulp refining devices used to produce mechanical or semi-mechanical pulp from wood chips in two or more stages of refining.

It has been conventional practice to construct mechanical pulping systems using one or more high consistency refiners to produce first stage pulp followed by steam separating cyclones and conveying equipment between stages and one or more additional high consistency refiners to produce second stage pulp. These systems are usually arranged so that one primary (first stage) refiner is dedicated to supply semi-refined pulp to one secondary (second stage) refiner. The combination of first stage refiner, steam separating cyclone, conveyor and second stage refiner forms a refining line.

The high consistency refiners used in conventional practice may have one or two refining zones. High consistency refiners having two identical refining zones are always used with the feed flow divided equally between the two zones and the two zones are said to operate in parallel. Each zone has the same thrust load applied and the machines have no provision for unequal thrust loads in the two zones.

Some manufacturers of single zone high consistency refiners have divided the zone into annular shaped sub-zones with separate thrust load control on each sub-zone. Each sub-zone is quite different from the other(s) in terms of diameter and effective refining velocity and there is no effective means to remove excess steam from between the sub-zones.

Low consistency pump-through refiners with two refining zones are well known and there are many different arrangements which provide series or parallel connection of the two zones. These refiners do not generate steam.

With a conventional two stage system there are several pieces of equipment connected in series. When any element requires servicing the entire line must be shut down. Each refiner requires its own motor, foundation and auxilliary equipment. Frequently the distance between first and second stage refiners is long requiring more extensive interstage equipment.

The present high consistency refiner has been developed to combine the first and second stage refining functions into a single machine. In this design two virtually identical refining zones are provided each of which can be adjusted axially independant of the other. Large thrust bearings are provided to permit differential loading of the two zones. Steam is separated from the interstage pulp using a cyclone device. Torque measuring devices together with motor load measurement provide an indication of the energy input to each refining zone.

Loading devices associated with each stator independently advance or retract the stator in each stage of the high consistency refiner to control the power consumption in each stage.

In view of the above it can be understood that a first object of the invention is to provide a two stage high consistency refiner with a single drive motor and single foundation which can produce two stage pulp of acceptable quality from wood chips.

A further object of the invention is to provide a refiner as described which permits the effective removal of excessive steam from the pulp between the first and second stages of refining.

Another object of the invention is to have two virtually identical refining zones of approximately equal diameter, area and peripheral speed.

An additional object of invention is to provide independant axial adjustment of two virtually identical refining zones in a single high consistency refiner and to provide thrust bearings which will accomodate unequal loads in the two zones.

A still further object of the invention is to provide a high consistency refiner of an efficient construction which may be economically manufactured and maintained.

Figure 1:
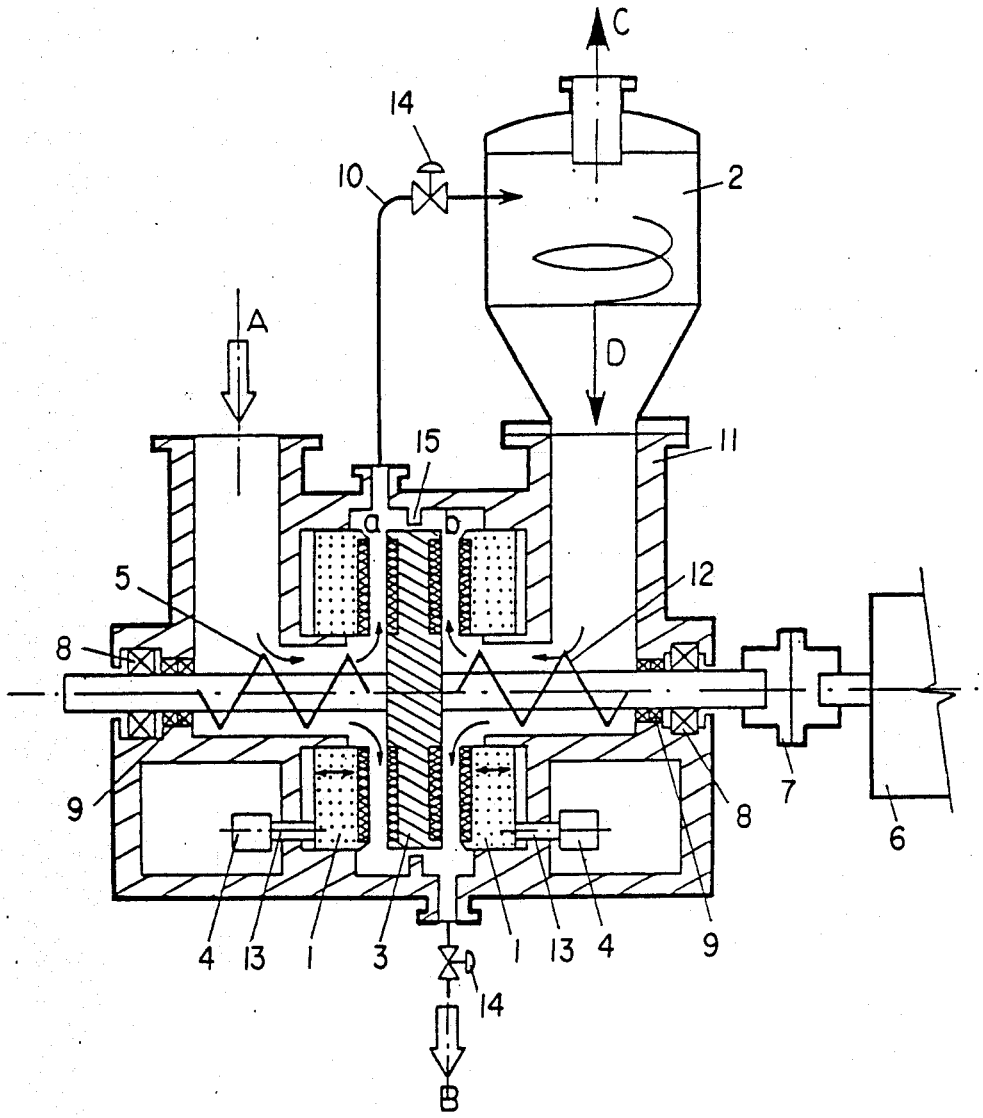
FIG. 1 is a side sectional view of the refiner.

Referring to FIG. 1, wood chips enter the high consistency refiner at point A and fall by gravity. The screw conveyor (5) transports the chips along the shaft to refining zone (a) where centrifugal force impels the chips into the refining gap. Semi-refined pulp is discharged through a short blow line (10) to the steam separating cyclone (2). Excess steam is removed at point C while the semi-refined pulp falls past point D and into the screw conveyor (12). Semi-refined pulp is conveyed to refining zone (b) where contrifugal force impels the fibers into the refining gap. Two stage refined pulp leaves the refiner at point B. The refiner rotor (3) is driven by a motor (6) through a coupling (7) at a suitable speed to provide good refining. The refiner shaft is supported in bearings (8) which are dimensioned for both radial and axial loads. Seals (9) separate the bearings from the refining process. The two stators (1) are independently advanced and retracted by loading devices (4) which may be either hydraulic or mechanical. The axial loads in the two refining zones may be substantially different and the net difference is transmitted to the thrust bearing. The reaction torque on each of the stators is measured in order to determine the relative power consumption of each refining zone. Each of the stators can be adjusted independently in order to optimize the power consumption and the final pulp quality. The refiner body (11) is constructed to provide an adequate support for the various components and to allow passages for flow of pulp and steam. Provisions are made to facilitate access to components requiring periodic servicing or replacement. The seal ring (15) maintains the separation of the discharge flow coming from the two refining zones (a) and (b). The pressure at the discharge of the two zones is maintained approximately equal by the automatic operation of control valves (14).

Figure 2:
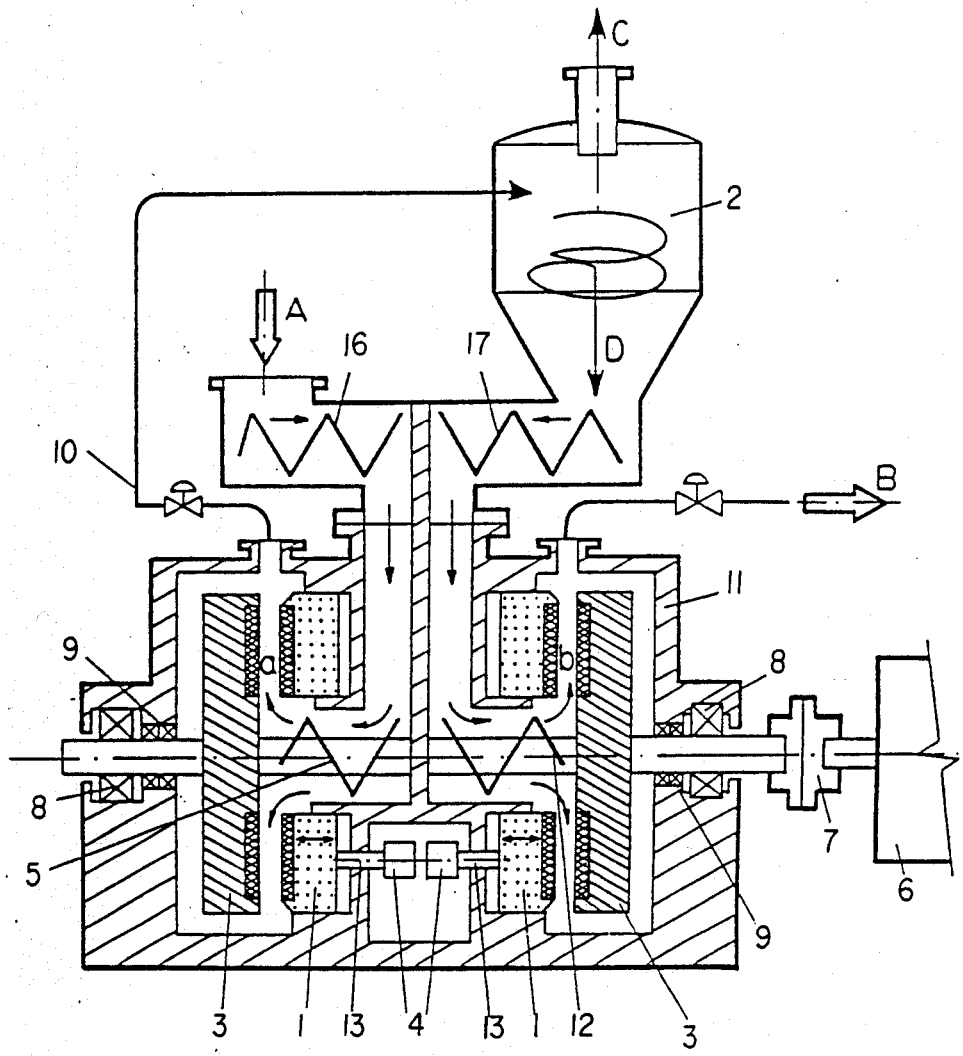
FIG. 2 is a side sectional view of a rotor refiner having bearing outboard of the two rotors.

In another embodiment of the invention, as shown in FIG. 2, wood chips enter the refiner at point A and fall by gravity into the screw conveyor (16). The chips fall from screw conveyor (16) into screw conveyor (5) and are transported along the shaft to refining zone (a) where centrifugal force impels the chips into the refining gap. Semi-refined pulp is discharged through a short blow line (10) to the steam separating cyclone (2). Excess steam is removed at point C while the semi-refined pulp falls past point D and into the screw conveyor (17). The pulp falls from screw conveyor (17) into screw conveyor (12) and is conveyed to refining zone (b) where centrifugal force impels the fibers into the refining gap. Two stage refined pulp leaves the refiner at point B. The refiner rotors (3) are driven by a motor (6)

through a couling (7) at a suitable speed to provide good refining. The refiner shaft is supported in bearings (8) which are dimensioned for both radial and axial loads. Seals (9) separate the bearings from the refining process. The two stators (1) are independently advanced and retracted by loading devices (4) which may be either hydraulic or mechanical. There are two or more loading devices on each stator and they are located symmetrically about the axis of rotation of the refiner shaft. The axial loads in the two refining zones may be substantially different and the net difference is transmitted to the thurst bearing. The reaction torque on each of the stators is measured using a load cell (13) to determine the relative power consumption of each refining zone. This measurement is used as a control input. Each of the stators can be adjusted independently in order to control the power consumption and to optimize the final pulp quality. The control can be manual or automatic. The refiner body (11) is constructed to produce an adequate support for the various components and to allow passages for flow of pulp and steam (including blowback steam). Provisions are made to facilitate access to components requiring periodic servicing or replacement.

Other possible embodiments will be evident to persons skilled in the art.

In each of the embodiments shown the high consistency refiner has a nominal throughput capacity of 10 metric tons of dry pulp per hour with a connected motor power of twenty megawatts at 1800 rpm.

the outer diameter of each refining zone is approximately sixty inches while the inner diameter is approximately thirty inches. The prssure containing components are designed for a maximum inlet or discharge pressure of 60 psig. The loading devices are capable of applying up to 160 tons of total axial force to each stator.

The thrust bearings are sized for a continuous axial load of forty tons and for short duration loads of up to eighty tons. Interlocks on the loading device controls prevent the thrust load from exceeding its design values.

What is claimed is:

1. A refiner for the two-stage production of pulp from unrefined material comprising wood chips comprises of:

(a) a single housing having two refining zones;

(b) a rotor fixedly mounted on a rotatable shaft for rotation therewith, said rotor positioned between opposing supported ends of said shaft and including opposing grinding surfaces;

(c) a first stator in opposing relation to one grinding surface of said rotor in a first refining zone and a second stator in opposing relation to the opposing grinding surface of said rotor in a second refining zone;

(d) means to measure the relative power consumption in each refining zone associated with the grinding of material which occurs by cooperation of said stators and said rotor in each refining zone;

(e) means to independently advance or retract said first and second stators either toward or away from said opposing grinding surfaces to vary both the clearance between said stators and said rotor and the axial load in each refining zone to maintain a desired power consumption in each refining zone;

(f) conveyor means to feed unrefined wood chips between said first stator and said rotor whereby gaseous by-products are produced and said wood chips are partially refined;

(g) separation means to separate said gaseous by-products from said partially refined wood chips; and (h) conveyor means to feed said partially refined wood chips subsequent to separation of said gaseous by-products between said second stator and said rotor whereby said partially refined wood chips are further refined.

2. The apparatus of claim 1 wherein said separation means comprises a cyclone separator.

3. The apparatus of claim 1 wherein said means to measure power consumption comprises torque measuring means.

4. The apparatus of claim 1 wherein said conveyor means comprises a screw conveyor.

5. A refiner for the two-stage production of pulp from unrefined material comprising wood chips comprised of:

(a) a single housing having two refined zones;

(b) first and second rotors fixedly mounted on a rotatable shaft for rotation therewith, said rotors being spaced axially from each other in first and second refining zones, respectively, with each rotor positioned between opposing supported ends of said shaft and including grinding surfaces on one surface thereof;

(c) a first stator in opposing relation to said grinding surface of said first rotor in said first refining zone and a second stator in opposing relation to said grinding surface of said second rotor in said second refining zone;

(d) means to measure the relative power consumption in each refining zone associated with the grinding of material which occurs by cooperation of said stators and said rotor in each refining zone;

(e) means to independently advance or retract said first and second stators either toward or away from said opposing grinding surfaces of said rotors to vary both the clearance between said stators and said rotors and the axial load in each refining zone;

(f) conveyor means to feed unrefined wook chips between said first stator and siad first rotor whereby gaseous by-products are produced and said wood chips are partially refined.

(g) separation means to separate said gaseous by-products from said partially refined wood chips; and (h) conveyor means to feed said partially refined wood chips subsequent to separation of said gaseous by-products between said second stator and said second rotor whereby said partially refined wood chips are further refined.

6. The apparatus of claim 5 wherein said separation means comprises a cyclone separator.

7. The apparatus of claim 5 wherein said means to measure power consumption comprises torque measuring means.

8. The apparatus of claim 5 wherein said conveyor means comprises a screw conveyor.

* * * * *